US005531636A

United States Patent [19]

Bissen

[11] Patent Number: 5,531,636

[45] Date of Patent: Jul. 2, 1996

[54] OSCILLATING DRUM SANDER

[76] Inventor: Eugene T. Bissen, 726 S. East St., Cale Doriu, Minn. 55921

[21] Appl. No.: 443,729

[22] Filed: May 18, 1995

[51] Int. Cl.[6] ..... B24B 7/06

[52] U.S. Cl. ..... 451/130; 451/65; 451/150

[58] Field of Search ..... 451/131, 150, 451/157, 184, 300, 304, 130, 65

[56] References Cited

U.S. PATENT DOCUMENTS

| | | | |
|---|---|---|---|
| D. 299,033 | 12/1988 | Steele | D15/124 |
| 335,117 | 2/1886 | Elmer et al. | 451/131 |
| 446,196 | 2/1891 | Wiederer | 451/157 |
| 532,348 | 1/1895 | Taylor et al. | 451/150 |
| 1,929,101 | 10/1933 | Schulte | 451/131 |
| 1,936,991 | 11/1933 | Pinkney | 451/300 |
| 3,032,931 | 5/1962 | Eversole | 451/130 |
| 3,126,674 | 3/1964 | Burt | 451/131 |
| 4,558,538 | 12/1985 | Green | 451/178 |
| 4,720,940 | 1/1988 | Green | 451/340 |
| 4,854,085 | 8/1989 | Huber | 451/357 |
| 5,040,340 | 8/1991 | Bischof et al. | 451/357 |
| 5,085,008 | 2/1992 | Jennings et al. | 451/184 |
| 5,319,888 | 6/1994 | Huber et al. | 451/357 |

*Primary Examiner*—Robert A. Rose

[57] ABSTRACT

A sander for mechanically abrading a surface of a workpiece. The inventive device includes a main frame having a moving conveyer extending therethrough. A first sanding drum assembly is positioned over the conveyer and rotates for initially abrading a surface of a workpiece positioned on the conveyer. A second sanding drum assembly is also positioned above the conveyer and is caused to rotate and axially oscillate to finally abrade the workpiece.

16 Claims, 5 Drawing Sheets

FIG 9
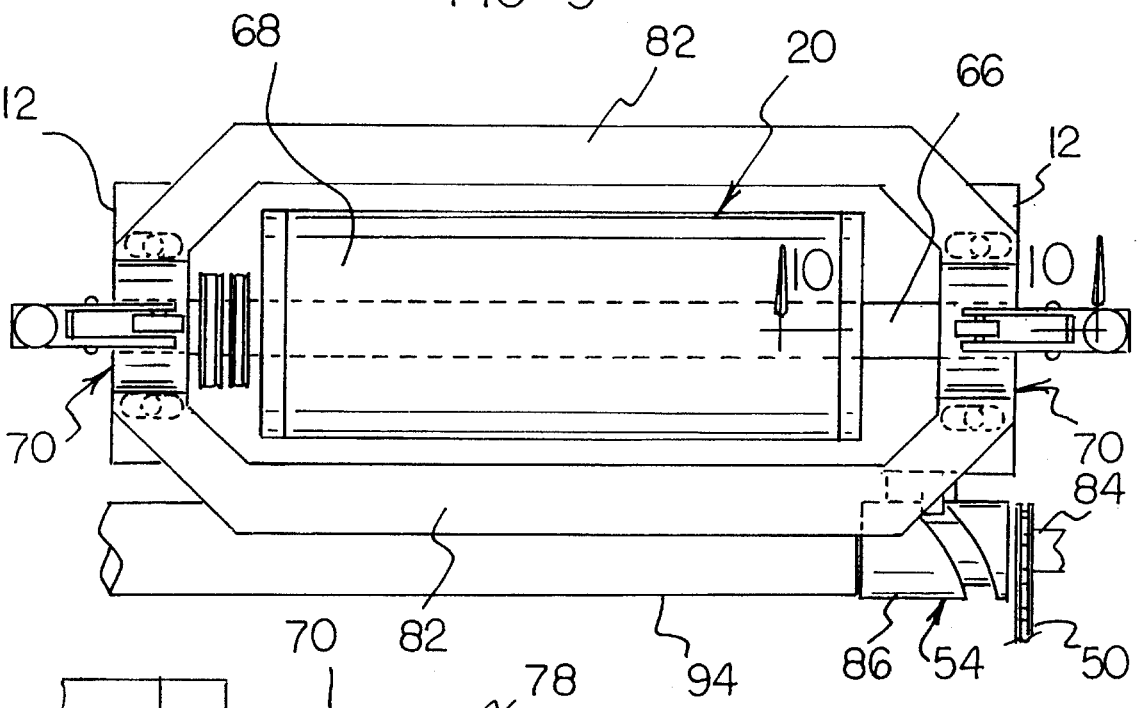
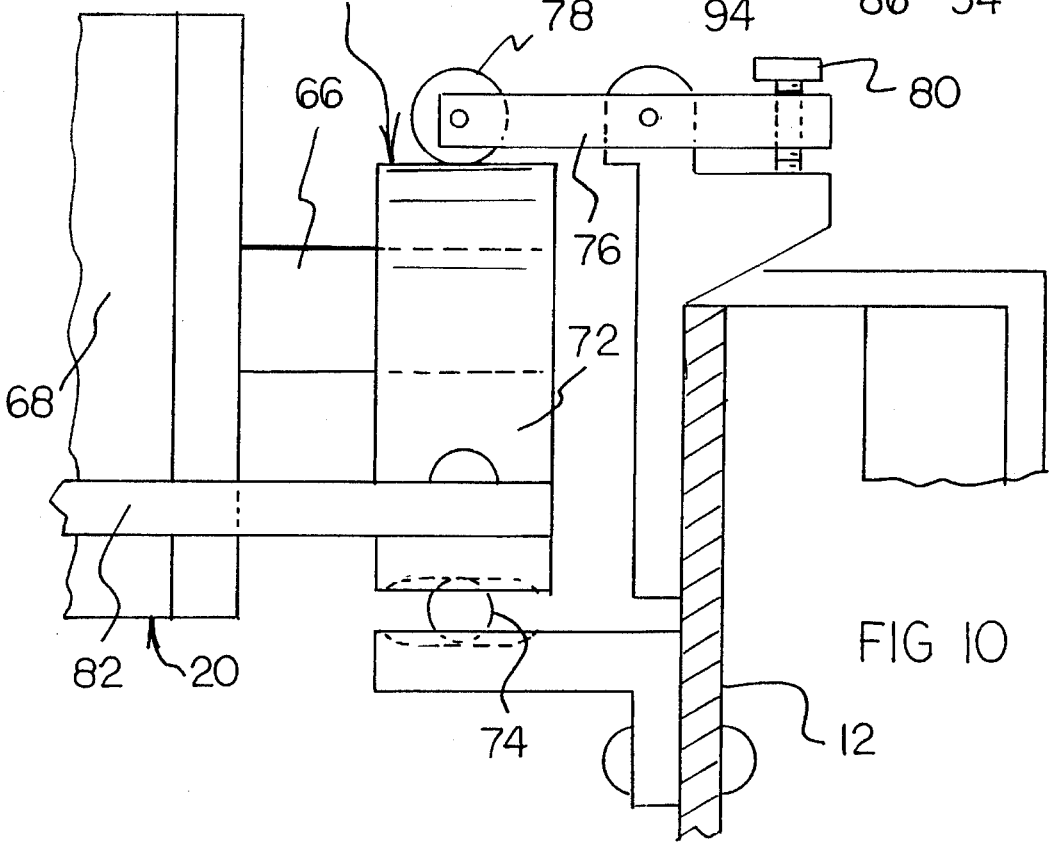
FIG 10

OSCILLATING DRUM SANDER

BACKGROUND OF THE INVENTION

1. Field of the Invention

The present invention relates to abrasive sanders and more particularly pertains to an oscillating drum sander for mechanically abrading a surface of a workpiece.

2. Description of the Prior Art

The use of abrasive sanders is known in the prior art. More specifically, abrasive sanders heretofore devised and utilized are known to consist basically of familiar, expected and obvious structural configurations, notwithstanding the myriad of designs encompassed by the crowded prior art which have been developed for the fulfillment of countless objectives and requirements.

Known prior art abrasive sanders include U.S. Pat. No. 5,319,888; U.S. Pat. No. 4,854,085; U.S. Pat. No. 4,558,538; U.S. Pat. No. 5,040,340; U.S. Pat. No. 4,720,940; and U.S. Pat. No. Des. 299,033.

While these devices fulfill their respective, particular objectives and requirements, the aforementioned patents do not disclose an oscillating drum sander for mechanically abrading surface of a workpiece which includes a main frame having a moving conveyer extending therethrough, a first sanding drum assembly positioned over the conveyer and rotating for initially abrading a surface of a workpiece positioned on the conveyer, and a second sanding drum assembly similarly positioned above the conveyer and caused to rotate and axially oscillate to finally abrade the workpiece.

In these respects, the oscillating dram sander according to the present invention substantially departs from the conventional concepts and designs of the prior art, and in so doing provides an apparatus primarily developed for the purpose of mechanically abrading a surface of a workpiece.

SUMMARY OF THE INVENTION

In view of the foregoing disadvantages inherent in the known types of abrasive sanders now present in the prior art, the present invention provides a new oscillating drum sander construction wherein the same can be utilized for mechanically abrading a surface of a workpiece. As such, the general purpose of the present invention, which will be described subsequently in greater detail, is to provide a new oscillating drum sander apparatus and method which has many of the advantages of the abrasive sanders mentioned heretofore and many novel features that result in a oscillating drum sander which is not anticipated, rendered obvious, suggested, or even implied by any of the prior art abrasive sanders, either alone or in any combination thereof.

To attain this, the present invention generally comprises a sander for mechanically abrading a surface of a workpiece. The inventive device includes a main frame having a moving conveyer extending therethrough. A first sanding drum assembly is positioned over the conveyer and rotates for initially abrading a surface of a workpiece positioned on the conveyer. A second sanding drum assembly is also positioned above the conveyer and is caused to rotate and axially oscillate to finally abrade the workpiece.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new oscillating drum sander apparatus and method which has many of the advantages of the abrasive sanders mentioned heretofore and many novel features that result in a oscillating drum sander which is not anticipated, rendered obvious, suggested, or even implied by any of the prior art abrasive sanders, either alone or in any combination thereof.

It is another object of the present invention to provide a new oscillating drum sander which may be easily and efficiently manufactured and marketed.

It is a further object of the present invention to provide a new oscillating drum sander which is of a durable and reliable construction.

An even further object of the present invention is to provide a new oscillating drum sander which is susceptible of a low cost of manufacture with regard to both materials and labor, and which accordingly is then susceptible of low prices of sale to the consuming public, thereby making such oscillating drum sanders economically available to the buying public.

Still yet another object of the present invention is to provide a new oscillating drum sander which provides in the apparatuses and methods of the prior art some of the advantages thereof, while simultaneously overcoming some of the disadvantages normally associated therewith.

Still another object of the present invention is to provide a new oscillating drum sander mechanically abrading a surface of a workpiece.

Yet another object of the present invention is to provide a new oscillating drum sander which includes a main frame having a moving conveyer extending therethrough, a first sanding drum assembly positioned over the conveyer and rotating for initially abrading a surface of a workpiece positioned on the conveyer, and a second sanding drum assembly similarly positioned above the conveyer and caused to rotate and axially oscillate to finally abrade the workpiece.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a top plan view of a second sanding drum assembly comprising a portion of the present invention.

FIG. 10 is a cross sectional view taken along line 10—10 of FIG. 9.

DESCRIPTION OF THE PREFERRED EMBODIMENT

Figure 1:
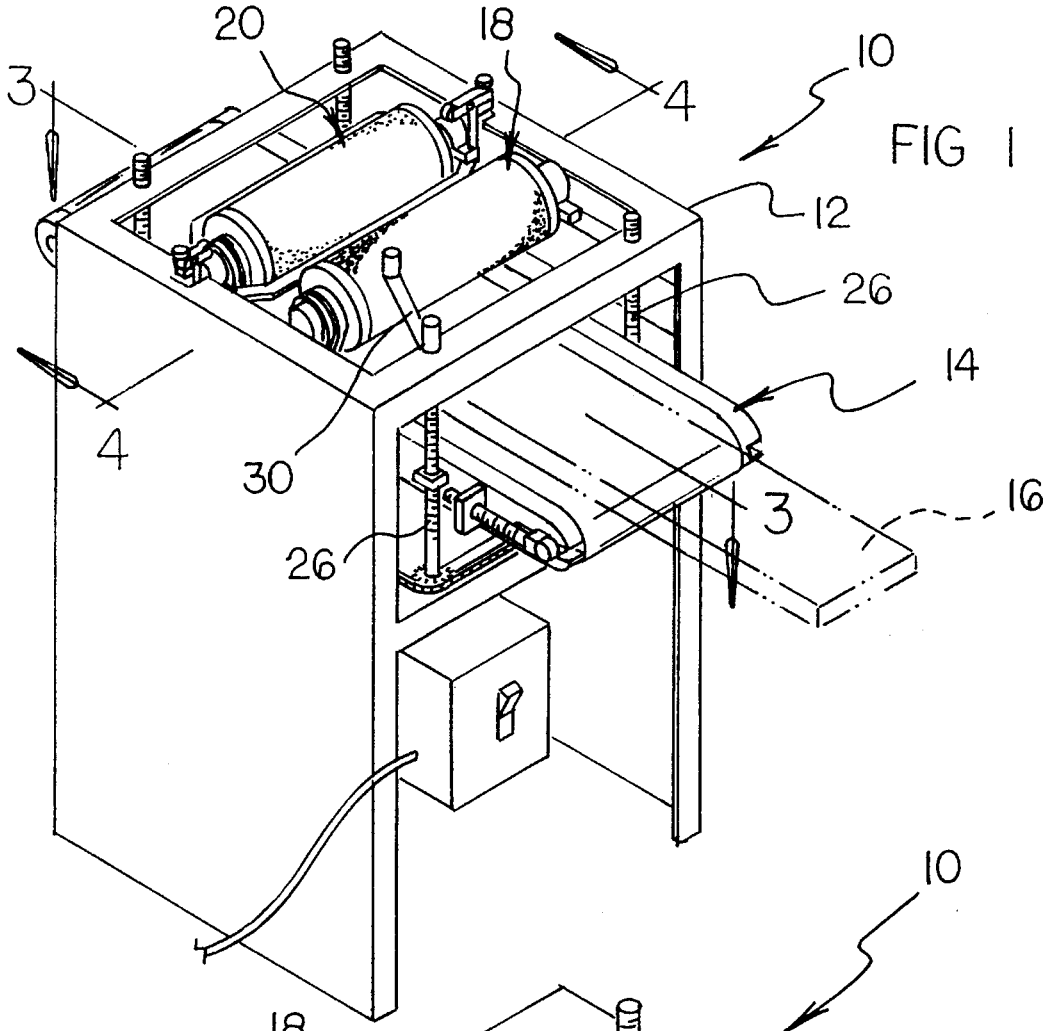
FIG. 1 is an isometric illustration of an oscillating drum sander according to the present invention in use.
Figure 2:
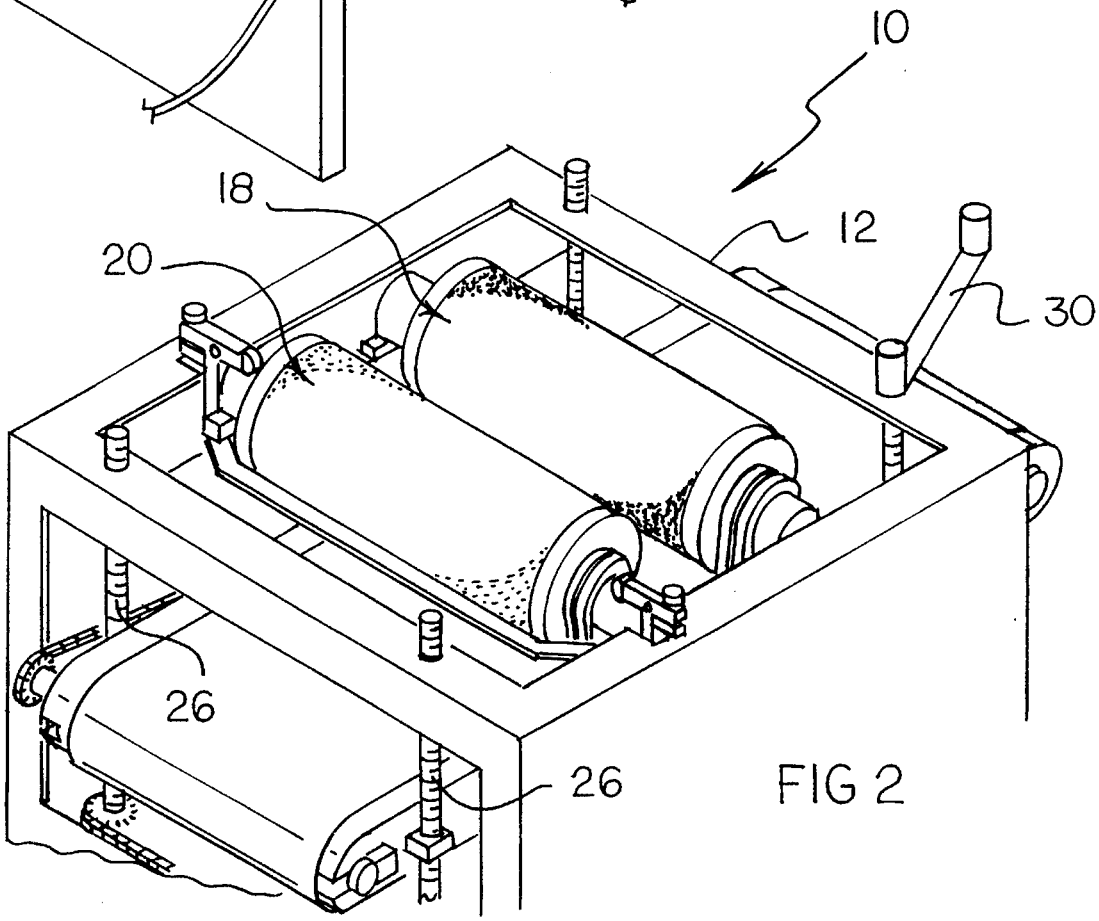
FIG. 2 is an enlarged rear isometric illustration of a portion of the present invention.

With reference now to the drawings, and in particular to FIGS. 1–10 thereof, a new oscillating drum sander embodying the principles and concepts of the present invention and generally designated by the reference numeral 10 will be described.

More specifically, it will be noted that the oscillating drum sander 10 comprises a main frame 12 having a conveyer 14 extending therethrough for receiving and moving a workpiece such as a board 16 through the main frame 12, as shown in FIG. 1 of the drawings. A first sanding assembly 18 is rotatably mounted to the main frame 12 and positioned above the conveyer 14 so as to extend transversely thereacross. The first sanding drum assembly 18 is powered so as to rotate and sand the workpiece or board 16 positioned upon the conveyer 14. Similarly, a second sanding drum assembly 20 is mounted above the conveyer 14 and caused to both rotate and axially oscillate relative to the main frame 12 so as to finally sand the workpiece or board 16 positioned on the conveyer 14. By this structure, the first sanding drum assembly 18 can initially sand the board 16, with the second sanding drum assembly 20 finally sanding the board 16 as it is passed through the main frame 12 upon the conveyer 14.

Figure 3:
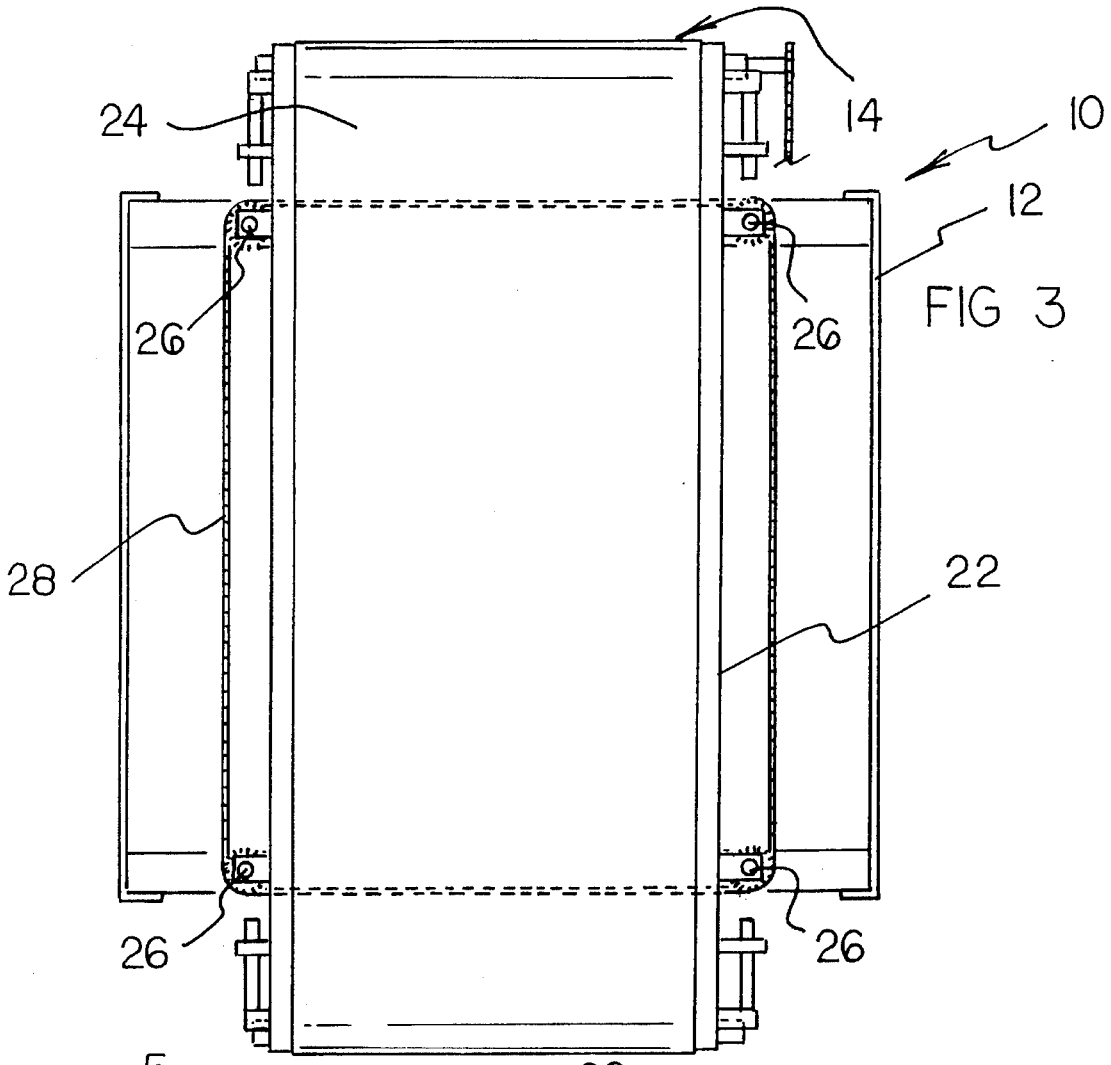
FIG. 3 is a cross sectional view taken along line 3—3 of FIG. 1.

Referring now to FIG. 3, it can be shown that the conveyer 14 of the present invention 10 preferably comprises a conveyer frame 22 having a conveyer belt 24 extending thereover. A plurality of threaded support rods 26 extend vertically through the main frame 12 and are rotatably mounted thereto. The threaded support rods 26 all extend in a substantially spaced and parallel orientation, and are preferably positioned in spaced pairs along laterally opposed sides of the conveyer frame 22. The threaded support rods 26 each threadably engage a portion of the conveyer frame 22 so as to support that portion of the conveyer frame relative to the main frame 12. The threaded support rods 26 each include an unlabeled support rod sprocket, with a synchronizing chain 28 extending over the support rod sprockets so as to rotatably couple the threaded support rods 26 together. A hand crank 30 is fixedly secured to one of the threaded support rods 26 and can be manually rotated so as to effect concurrent rotation of all of the threaded support rods, thereby altering a level position of the conveyer 14 within the main frame 12 of the device 10.

Figure 5:
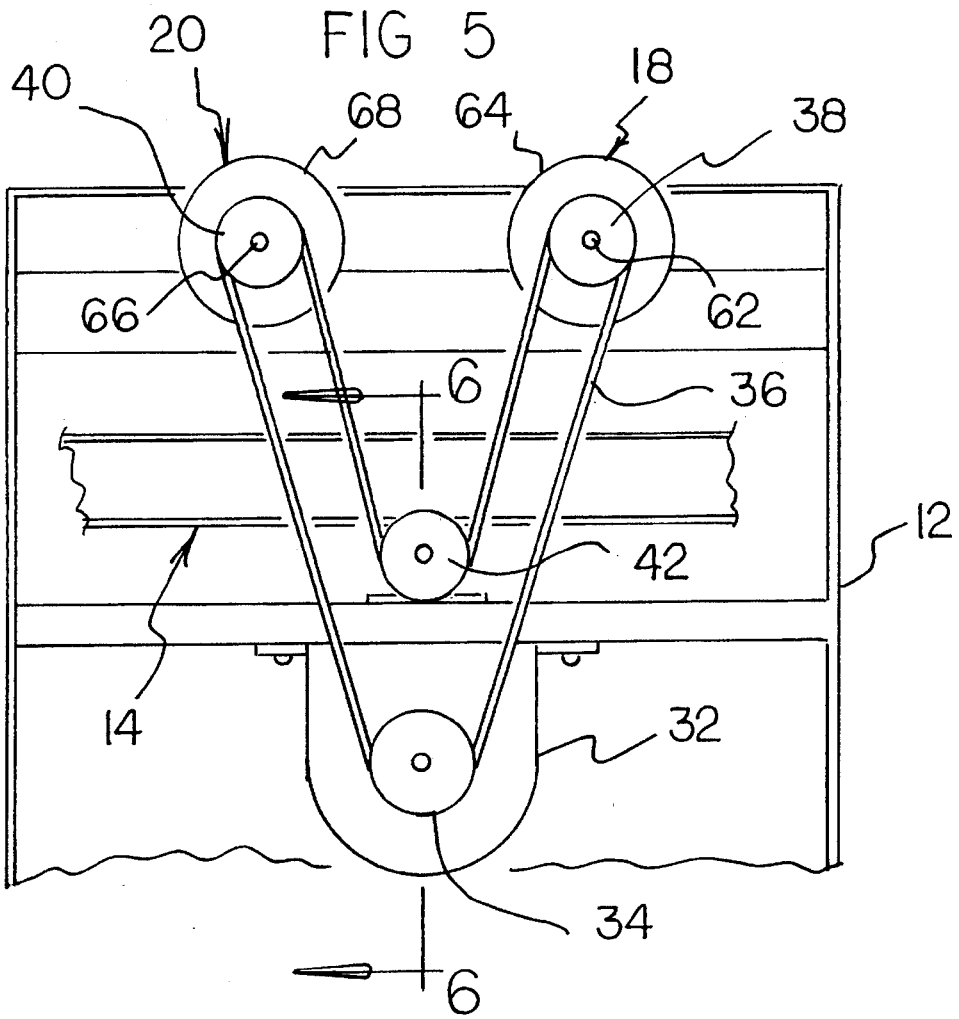
FIG. 5 is a left side elevation view, partially in cross section, of a portion of the present invention.
Figure 6:
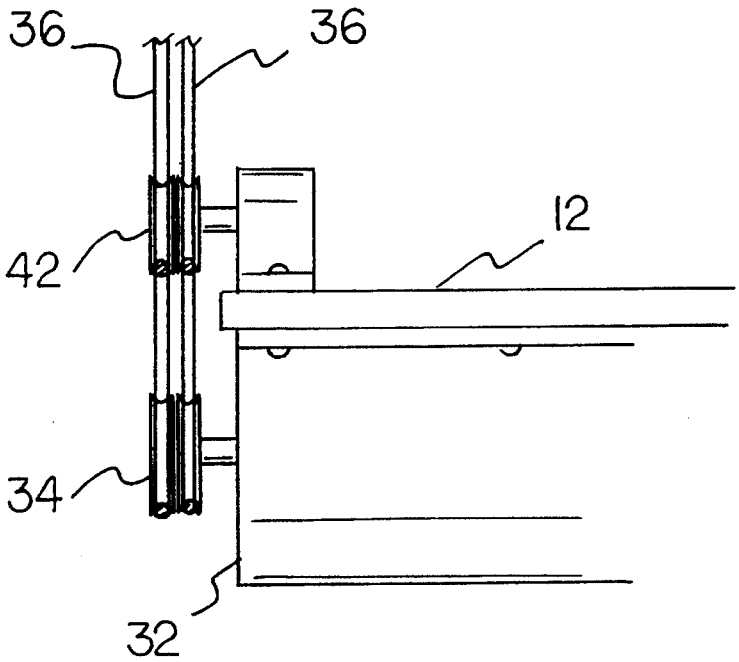
FIG. 6 is a cross sectional view taken along line 6—6 of FIG. 5.
Figure 7:
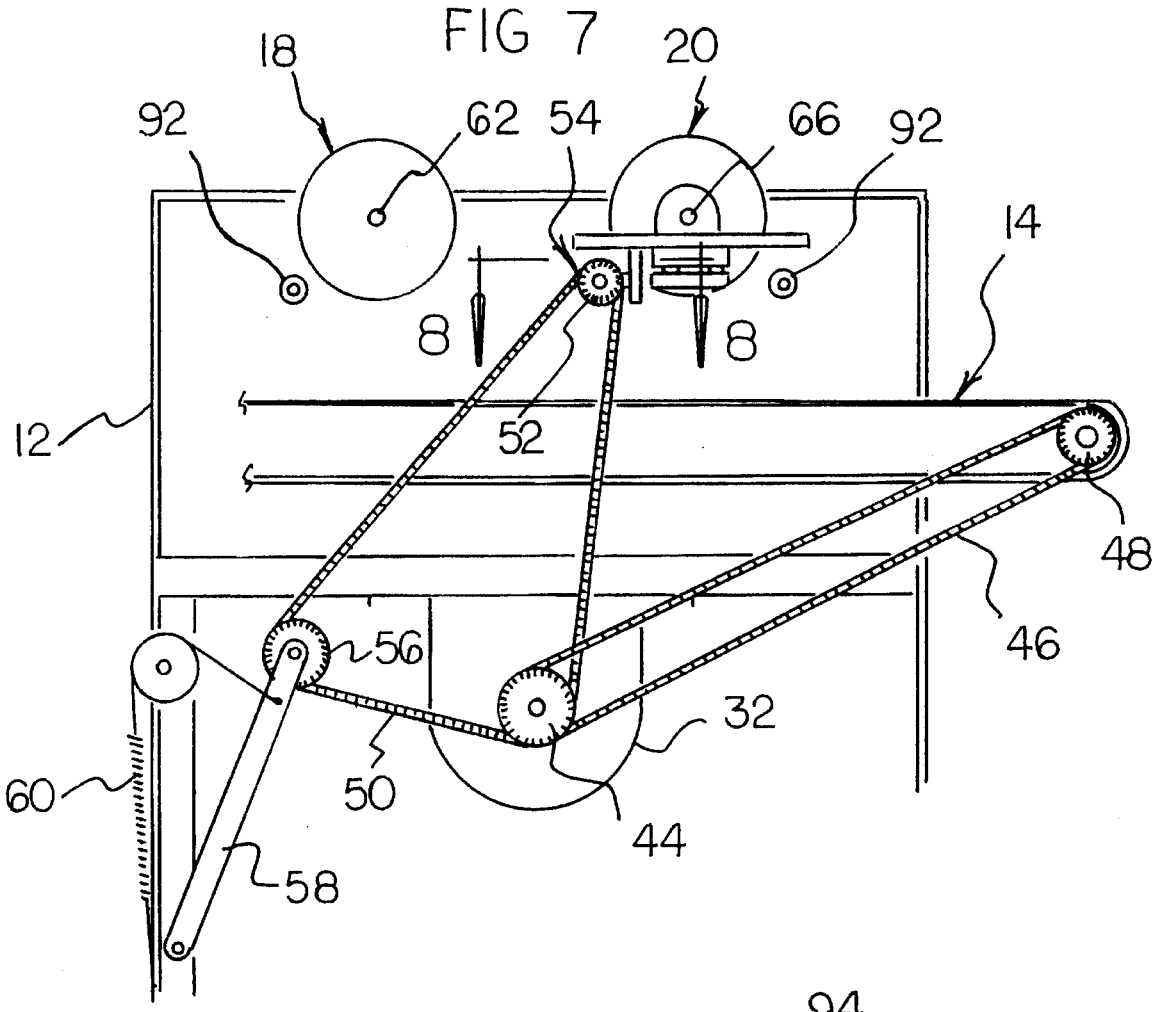
FIG. 7 is a right side elevation view, partially in cross section, of a portion of the present invention.

Referring now to FIGS. 5 through 7, it can be shown that the present invention 10 further comprises an electric motor 32 which is mounted to the main frame 12 and includes oppositely projecting and unlabeled motor shafts extending therefrom. As shown in FIG. 5, a motor pulley 34 is mounted to a first one of the motor shafts and receives a drive belt 36 extending thereover. The drive belt 36 extends from the motor pulley 34 and over a first drum pulley 38 of the first sanding drum assembly 18. The drive belt 36 continues from the first drum pulley 38 to extend over a second drum pulley 40 of the second sanding drum assembly 20. An idler pulley 42 can be engaged-to the drive belt 36 between the first drum pulley 38 and the second drum pulley 40 so as to increase a wrap of the drive belt 36 about the first and second drum pulleys and increase friction engagement between the drive belt and the respective drum pulleys. By this structure, energization of the motor 32 will effect rotation of the motor pulley 34 and subsequent rotation of the sanding drum assemblies 18 and 20.

As shown in FIG. 7, a second motor shaft of the motor 32 includes a pair of motor sprockets secured thereto. A conveyer chain 46 extends from one of the motor sprockets 44 and over a conveyer sprocket 48 of the conveyer 14 to effect rotation of at least one roller of the conveyer to cause the conveyer belt 24 to rotate about the conveyer frame 22. A cam chain 50 extends from a second one of the motor sprockets 44 and about a cam sprocket 52 of an oscillation means 54 of the second sanding drum assembly 20 which operates for axially oscillating the second sanding drum assembly. If desired or needed, an idler sprocket 56 can be engaged to the cam chain 50 and supported on a pivoting idler arm 58 biased towards the main frame 12 by a tension spring 60 so as to eliminate any slack in the cam chain 50. Alternatively, the cam chain 50 can be configured so as to extend directly between the second one of the motor sprockets 44 and the cam sprocket 52 of the oscillating means 54.

Referring now to FIG. 5, it can be shown that the first sanding drum assembly 18 comprises a first axle 62 rotatably supported by the frame 12 above the conveyer 14. The first drum pulley 38 is secured to the first axle 62 so as to cause a rotation thereof during operation of the device 10. A first abrasive cylinder 64 is secured to the first axle 62 so as to rotate with the first drum pulley 38. Similarly, the second sanding drum assembly 20 comprises a second axle 66 rotatably mounted relative to the frame 12 and coupled to the second drum pulley 40 such that the second axle 66 rotates with the second drum pulley during operation of the device 10. A second abrasive cylinder 68 is secured to the second axle 66 and thus rotates during energization of the electric motor 32. By this structure, the abrasive cylinders 64 and 68 rotate and engage the workpiece 16 during passage thereof through the main frame 12.

Referring now to FIGS. 9 and 10 wherein the second sanding drum assembly 20 is illustrated in detail, it can be shown that the second sanding drum assembly includes transverse rotational bearing means 70 which support the second axle 66 relative to the main frame 12 so as to permit both rotation of the second axle and axial movement thereof relative to the main frame 12. As shown in FIG. 10, the transverse rotational bearing means 70 comprises a pair of spaced pillow block bearings 72 each engaged to an individual opposed end of the second axle 66. The pillow block bearings 72 are each supported relative to a portion of the main frame 12 by a lower roller 74 residing within facing grooves. The lower roller 74 may comprise a sphere such as a ball bearing or the like confined within the unlabeled grooves formed in the lower surface of the pillow block bearings 72 and the upper surface of a portion of the main frame 12. To secure the pillow block bearings 72 relative to the main frame 12, an upper roller support arm 76 is pivotally mounted to a portion of the main frame 12 and extends over the pillow block bearing 72. An upper roller 78 is rotatably mounted to a first end of the upper roller support arm 76 and engages an upper surface of the pillow block bearing 72 so as to capture the pillow block bearing 72 between the upper roller 78 and the lower roller 74. An adjustment fastener 80 is threadably directed through a second end of the upper roller support arm 76 and can be rotatably adjusted so as to cause the upper roller 78 to engage the pillow block bearings 72 at a desired normal force. To ensure that the pillow block bearings 72 are fixed at a predetermined spacing, at least one transverse arm 82 can extend between the pillow block bearings 72 for supporting the same in a substantially spaced and parallel orientation as shown in FIG. 9 of the drawings. By this structure, the pillow block bearings 72 supports the second axle 66 in a rotatable relationship relative to the main frame 12, with the lower roller 74 and the upper roller 78 cooperating to support the pillow block bearings 72 and permitting transverse or axial movement of the second axle 66 relative to the main frame 12.

Figure 4:
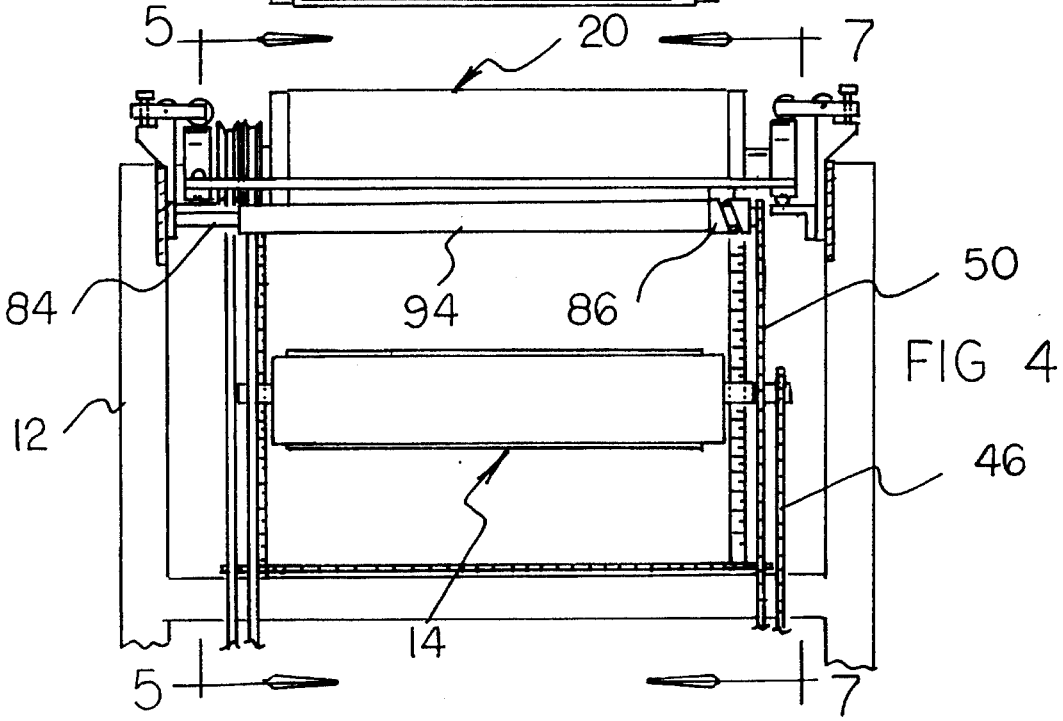
FIG. 4 is a cross sectional view taken along line 4—4 of FIG. 1.
Figure 8:
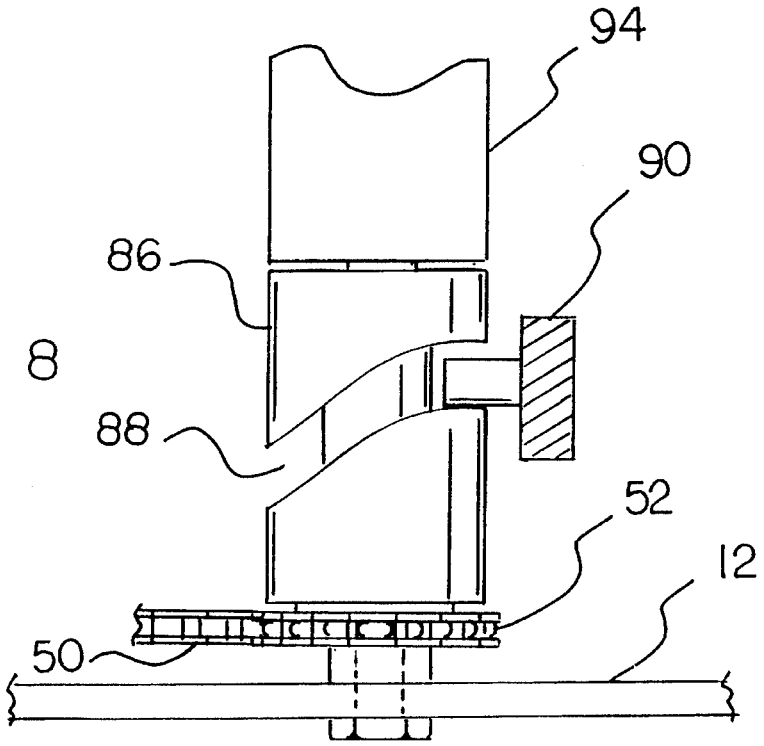
FIG. 8 is a cross sectional view taken along line 8—8 of FIG. 7.

To effect oscillation of the second abrasive cylinder 68, the oscillation means 54 of the second sanding drum assembly 20 comprises a cam axle 84 rotatably mounted relative to the main frame 12, as shown in FIG. 4 of the drawings. A cam 86 is coupled to the cam axle 84 and is coupled to the cam sprocket 52 driven by the cam chain 50. The cam 86, as shown in FIG. 8, is shaped so as to define an undulating groove 88 extending circumferentially thereabout which receives a portion of the a follower 90. The follower 90 is coupled relative to the transverse rotational bearing means 70 so as to cause oscillation of the pillow block bearings 72 relative to the main frame 12, thereby axially oscillating the second abrasive cylinder 68 of the second sanding drum assembly 20. By this structure, rotation of the second abrasive cylinder 68, with concurrent oscillation thereof can be simultaneously accomplished during use of the device 10.

Referring now to FIGS. 7 and 8, with concurrent reference to FIG. 4, it can be shown that the present invention may additionally comprise holding rollers for biasing the workpiece 16 against the conveyer 14. To this end, the holding rollers preferably include a pair of spaced and substantially parallel end holding rollers 92 which extend transversely across an interior of the main frame 12 and are positioned on opposed sides of the sanding drum assemblies 18 and 20. If desired, a medial holding roller 94 can be coupled to the cam axle 84, as shown in FIG. 4. The medial holding roller 94 can be secured to the cam axle 84 so as to rotate therewith, or alternatively, may be freely rotatable about the cam axle 84 as desired.

In use, the oscillating drum sander 10 of the present invention can be easily utilized for effecting initial and final sanding of a workpiece such as the board 16 illustrated in FIG. 1 of the drawings. Preferably, the first abrasive cylinder 64 is of a coarse grade of sanding material, with the second abrasive cylinder 68 being of a fine sanding material. The abrasive cylinders 64 and 68 may each comprise a cylindrical roller having a sandpaper sleeve positioned thereover. Preferably, the first abrasive cylinder 64 is of a thirty-six grit sanding material, with the second abrasive cylinder 68 being of a one-hundred-twenty grit sanding material. The first sanding drum assembly 18 can also oscillate utilizing structure identical to the second sanding drum assembly 20, if so desired. Preferably, the second sanding drum assembly 20 oscillates in the range of thirty to sixty cycles per minute, and axially travels in the range of approximately three-eighths of an inch to one-half of an inch of axial travel.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An oscillating drum sander comprising:

a main frame defining a longitudinal axis along which a workpiece is adapted to move;

an oscillating sanding drum assembly mounted to the main frame and caused to both rotate and axially oscillate relative to an axis transverse to the longitudinal axis of the main frame so as to sand a workpiece when positioned in contact with the oscillating sanding drum assembly, further comprising a drive motor mounted to the main frame, the oscillating sanding drum assembly being positioned in mechanical communication with the motor, wherein the oscillating sanding drum assembly comprises an axle supported by said frame and defining said transverse axis; and an abrasive cylinder mounted about said axle, the abrasive cylinder being positioned in mechanical communication with said motor, wherein the oscillating sanding drum assembly further comprises transverse rotational bearing means for supporting the axle relative to the main frame so as to permit both rotation of said axle and axial movement thereof relative to the main frame, and wherein the transverse rotational bearing means comprises a pair of spaced pillow block bearings, respectively, each engaged to an individual opposed end of said axle, said pillow block bearings each being supported for movement in the direction of said transverse axis relative to a portion of the main frame.

2. The oscillating drum sander of claim 1, wherein the pillow block bearings are each supported for transverse movement relative to a portion of the main frame by lower rollers interposed between the pillow block bearings and the portion of the main frame.

3. The oscillating drum sander of claim 2, wherein the pillow block bearings are each further supported for transverse movement to a portion of the main frame by upper rollers coupled to the main frame and engaging upper surfaces of the pillow block bearings.

4. The oscillating drum sander of claim 3, and further comprising upper roller support arms pivotally mounted to a portion of the main frame and each extending over an individual one of the pillow block bearings, with the upper roller being rotatably mounted to a first end of the upper roller support arm and engaging an upper surface of the respective pillow block bearing so as to capture the pillow block bearing between the upper roller and the lower rollers; and an adjustment fastener directed through a second end of the upper roller support arm being adjustable so as to cause the upper roller to engage the pillow block bearings.

5. The oscillating drum sander of claim 4, and further comprising at least one transverse arm extending between the pillow block bearings for supporting the pillow block bearings in a substantially spaced and parallel orientation.

6. The oscillating drum sander of claim 5, wherein the motor includes a first motor shaft extending therefrom; and further comprising a motor pulley mounted to the motor shaft; a drive belt extending over the motor pulley; and a second drum pulley mechanically coupled to the oscillating sanding drum assembly, the drive belt extending over the second drum pulley.

7. The oscillating drum sander of claim 6, and further comprising a fixed sanding assembly rotatably mounted to the main frame and caused to rotate relative to the main frame so as to sand a workpiece when positioned in contact with the fixed sanding drum assembly.

8. The oscillating drum sander of claim 7, wherein the fixed sanding drum assembly comprises a first axle supported by the frame; a first abrasive cylinder mounted about the first axle; and a first drum pulley mechanically coupled to the first abrasive cylinder, the drive belt extending over the first drum pulley.

9. The oscillating drum sander of claim 8, and further comprising a conveyer extending through the main frame and positioned beneath the sanding drum assemblies.

10. The oscillating drum sander of claim 9, wherein the conveyer comprises a conveyer frame having a conveyer belt extending thereover.

11. The oscillating drum sander of claim 10, wherein the conveyor further comprises a plurality of substantially spaced and parallel threaded support rods extending vertically through the main frame and rotatably mounted thereto, the threaded support rods being positioned in spaced pairs along laterally opposed sides of the conveyer frame, the threaded support rods each threadably engaging a portion of the conveyer frame so as to support the portion of the conveyer frame relative to the main frame.

12. The oscillating drum sander of claim 11, wherein the threaded support rods each include a support rod sprocket projecting radially therefrom; and further comprising a synchronizing chain extending over the support rod sprockets to rotatably couple the threaded support rods together; and a hand crank fixedly secured to one of the threaded support rods which can be manually rotated so as to effect concurrent rotation of all of the threaded support rods, thereby altering a level position of the conveyer relative to the main frame.

13. The oscillating drum sander of claim 12, and further comprising holding rollers for biasing a workpiece against the conveyer.

14. The oscillating drum sander of claim 13, wherein the holding rollers include a pair of spaced and substantially parallel end holding rollers which extend transversely across the main frame and are positioned on opposed sides of the sanding drum assemblies.

15. The oscillating drum sander of claim 1, wherein the oscillating sanding drum assembly further includes an oscillation means for axially oscillating the sanding drum assembly relative to the main frame in the direction of said transverse axis.

16. The oscillating drum sander of claim 15, wherein the oscillation means of the oscillating sanding drum assembly comprises a cam axle rotatably mounted relative to the main frame; a cam mounted about the cam axle, the cam being in mechanical communication with the motor, the cam being shaped so as to define an undulating groove extending circumferentially thereabout; and a follower coupled relative to the transverse rotational bearing means so as to cause oscillation of the pillow block bearings relative to the main frame, thereby axially oscillating the abrasive cylinder of the oscillating sanding drum assembly relative to the main frame.

* * * * *